US009299196B2

(12) United States Patent
Nambudiri et al.

(10) Patent No.: US 9,299,196 B2
(45) Date of Patent: Mar. 29, 2016

(54) METHOD AND SYSTEM FOR HIGH SPEED PRINTING USING DROP-ON DEMAND TECHNOLOGY THAT COMPENSATES FOR DROPLET SATELLITES

(75) Inventors: Easwaran Nambudiri, Rye Brook, NY (US); John P. Miller, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 3529 days.

(21) Appl. No.: 11/020,877

(22) Filed: Dec. 22, 2004

(65) Prior Publication Data

US 2006/0132809 A1 Jun. 22, 2006

(51) Int. Cl.
*G07B 17/00* (2006.01)

(52) U.S. Cl.
CPC *G07B 17/00508* (2013.01); *G07B 2017/00532* (2013.01); *G07B 2017/00637* (2013.01)

(58) Field of Classification Search
USPC ..... 347/9, 11, 12, 40, 41, 248, 15, 19, 43, 347/100; 400/103; 358/2.1, 3.26, 1.11, 1.9, 358/1.8, 3.07; 248/71; 345/443; 382/299
See application file for complete search history.

(56) References Cited

U.S. PATENT DOCUMENTS 4,437,122 A * 3/1984 Walsh et al. ..... 358/3.07
5,270,728 A * 12/1993 Lund et al. ..... 358/1.8
5,526,474 A * 6/1996 Fukushima ..... 345/443
5,535,307 A * 7/1996 Glass ..... 358/1.8
5,650,858 A * 7/1997 Lund ..... 358/3.07
5,661,507 A * 8/1997 Sperry ..... 347/9
5,677,714 A * 10/1997 Klassen et al. ..... 347/9
5,719,601 A * 2/1998 Moore et al. ..... 347/9
5,742,300 A * 4/1998 Klassen ..... 347/9
5,767,870 A * 6/1998 Klassen et al. ..... 347/9
5,767,889 A 6/1998 Ackley
5,890,818 A * 4/1999 Sansone ..... 400/103
6,406,111 B1 * 6/2002 Klassen et al. ..... 347/9
6,454,389 B1 * 9/2002 Couwenhoven et al. ..... 347/40
6,554,396 B1 4/2003 Mizutani
6,585,433 B2 7/2003 Davies et al.
6,604,806 B1 * 8/2003 Yamada et al. ..... 347/15
6,631,012 B2 10/2003 Athens et al.
6,650,793 B1 * 11/2003 Lund et al. ..... 382/299
6,682,170 B2 * 1/2004 Hotomi et al. ..... 347/43
6,776,544 B2 8/2004 Jauert
6,804,417 B1 * 10/2004 Lund et al. ..... 382/299

(Continued)

FOREIGN PATENT DOCUMENTS

EP 0889428 A2 1/1999
EP 1291187 A1 3/2003
JP 2003237059 8/2003

*Primary Examiner* — Nicholas Pachol
(74) *Attorney, Agent, or Firm* — Brian A. Lemm; Charles R. Malandra, Jr.; Steven J. Shapiro

(57) ABSTRACT

Methods and systems for using ink-jet technology for high speed printing are provided. Print growth between pixels in an image is significantly reduced or eliminated by adjusting the printing of the pixels based on the status of the following pixel to be printed, i.e., whether the following pixel is either black or white. If a black pixel, formed by a plurality of columns of dots, is being followed by a white pixel, the column of dots closest to the white pixel will not be printed, and the column of dots in the black pixel next to the column of dots closest to the white pixel are staggered such that the pixel appears filled despite the absence of the column of dots closest to the white pixel and will still be properly read as a black pixel by a scanner reading the image.

13 Claims, 8 Drawing Sheets

(56) References Cited

U.S. PATENT DOCUMENTS

| | | | | |
|---|---|---|---|---|
| 6,834,936 | B2 * | 12/2004 | Teshigawara et al. | 347/40 |
| 6,919,973 | B1 * | 7/2005 | Meyer et al. | 358/3.26 |
| 6,970,258 | B1 * | 11/2005 | Meyer et al. | 358/1.11 |
| 6,997,541 | B2 * | 2/2006 | Edamura et al. | 347/41 |
| 7,016,073 | B1 * | 3/2006 | Meyer et al. | 358/1.9 |
| 7,046,267 | B2 * | 5/2006 | Franklin et al. | 347/248 |
| 7,046,397 | B2 * | 5/2006 | Loce et al. | 358/1.9 |
| 7,085,003 | B1 * | 8/2006 | Belkhir | 358/1.9 |
| 7,102,784 | B1 * | 9/2006 | Loce et al. | 358/1.9 |
| 7,185,963 | B1 * | 3/2007 | Alfaro et al. | 347/15 |
| 7,227,669 | B2 * | 6/2007 | Loce et al. | 358/2.1 |
| 7,227,670 | B2 * | 6/2007 | Loce et al. | 358/2.1 |
| 7,311,395 | B2 * | 12/2007 | Vinals-Matas et al. | 347/40 |
| 7,384,112 | B2 * | 6/2008 | Hasegawa | 347/11 |
| 7,396,048 | B2 * | 7/2008 | Janetzke et al. | 283/71 |
| 2002/0027572 | A1 * | 3/2002 | Kato et al. | 347/15 |
| 2002/0063750 | A1 * | 5/2002 | Kanda et al. | 347/41 |
| 2002/0067392 | A1 * | 6/2002 | Alfaro | 347/41 |
| 2004/0080788 | A1 * | 4/2004 | Heydinger | 358/2.1 |
| 2005/0088500 | A1 * | 4/2005 | Auslander | 347/100 |
| 2006/0087527 | A1 * | 4/2006 | de Pena et al. | 347/12 |

* cited by examiner

METHOD AND SYSTEM FOR HIGH SPEED PRINTING USING DROP-ON DEMAND TECHNOLOGY THAT COMPENSATES FOR DROPLET SATELLITES

FIELD OF THE INVENTION

The invention disclosed herein relates generally to printing systems, and more particularly to a method and system for high speed printing that utilizes drop-on-demand technology.

BACKGROUND OF THE INVENTION

Mail processing systems for printing postage indicia on envelopes and other forms of mail pieces have long been well known and have enjoyed considerable commercial success. There are many different types of mail processing systems, ranging from relatively small units that handle only one mail piece at a time, to large, multi-functional units that can process thousands of mail pieces per hour in a continuous stream operation. The larger mailing machines often include different modules that automate the processes of producing mail pieces, each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering module, i.e., applying evidence of postage to the mail piece. The exact configuration of the mailing machine is, of course, particular to the needs of the user.

Typically, a control device, such as, for example, a microprocessor, performs user interface and controller functions for the mailing machine. Specifically, the control device provides all user interfaces, executes control of the mailing machine and print operations, calculates postage for debit based upon rate tables, provides the conduit for the Postal Security Device (PSD) to transfer postage indicia to the printer, operates with peripherals for accounting, printing and weighing, and conducts communications with a data center for postage funds refill, software download, rates download, and market-oriented data capture. The control device, in conjunction with an embedded PSD, constitutes the system meter that satisfies U.S. information-based indicia postage meter requirements and other international postal regulations regarding closed system meters. The United States Postal Service (USPS) initiated the Information-Based Indicia Program (IBIP) to enhance the security of postage metering by supporting new methods of applying postage to mail.

The USPS has published draft specifications for the IBIP that define the requirements for the indicium to be applied to mail produced by closed systems. An example of such an indicium is illustrated in FIG. 1. The indicium 10 consists of a two-dimensional (2D) barcode 12 and certain human-readable information 14. Some of the data included in the barcode 12 can include, for example, the PSD manufacturer identification, PSD model identification, PSD serial number, values for the ascending and descending registers of the PSD, postage amount, and date of mailing. In addition, a digital signature is required to be created by the PSD for each mail piece and placed in the digital signature field of the barcode. Verification of indicium is performed by the postal service scanning a mail piece to read the 2D barcode 12 and verifying the information contained therein, including the digital signature. If the verification is unsuccessful, indicating that the indicium may not be authentic, the mail piece may not be delivered.

Since verification of the indicium requires reading the 2D barcode 12 and verifying the information contained therein, it is critical that the 2D barcode 12 be printed with sufficient resolution and clarity such that the scanners/readers are able to properly read and interpret the data. The 2D barcode 12 is approximately 0.8 inches by 0.8 inches and formed by a 40×40 array of pixels, with each pixel being 0.020 inches by 0.020 inches. Each pixel will be either black or white. As used herein, a black pixel indicates a pixel in which printing is performed, regardless of the ink color, and a white pixel indicates a pixel in which no printing is performed. If the pixel is black, a plurality of dots (depending upon the dots per inch of the printer used to print the barcode 12) are printed in the pixel. If the pixel is to be white, no dots are printed in the pixel. The data for the 2D barcode 12 is thus encoded as a series of black/white pixels and can therefore be read and interpreted by the verification equipment. One of the factors that affects the readability of the 2D barcode 12 is the size of each of the pixels (20 mils by 20 mils). If the size of each of the pixels is consistent, there is less chance of a pixel being incorrectly read and misinterpreted as either black or white. It is therefore important to maintain a consistent size for each of the pixels in the barcode 12.

In recent years, ink-jet printing systems have been utilized in mail processing systems. Ink-jet printing systems, as used herein, includes any form of printing wherein print control signals control a print mechanism to eject ink droplets from a plurality of nozzles to produce a matrix of pixels, i.e. picture elements, to represent an image. An ink supply, typically in the form of a reservoir, supplies ink to the print mechanism. FIGS. 2A-2D illustrate a cross-sectional view of an ink droplet 20 being discharged from a nozzle 16 of an ink-jet printing system onto a medium 18 passing beneath the nozzle 16 that is moving in the direction indicated by the arrow A. As shown in FIG. 2A, when droplet 20 is discharged from nozzle 16, it leaves a tail 22. The ink then begins to form a main droplet 20*a* and satellites 20*b*, 20*c*, as shown in FIG. 2B. The ink then splits into a main droplet 20*a* and satellites 20*b*, 20*c* as shown in FIG. 2C. The main droplet 20*a* contacts the medium 18 at a first location as shown in FIG. 2C. Since the medium 18 is moving in the direction indicated by arrow A, the satellite 20*b* will contact the medium 18 at a point to the left of the main droplet 20*a* as illustrated in FIG. 2D, and the satellite 20*c* will contact the medium to a point further left of the satellite 20*b*. The distance between the main droplet 20*a* and satellites 20*b*, 20*c* on the medium is dependent upon several factors, including the speed at which the medium is moving. Many current high speed mail processing systems will transport the medium at 70 inches per second (ips) or greater. The higher the speed of the medium, the greater the distance between the main droplet 20*a* and the satellites 20*b*, 20*c*.

The formation of the satellites 20*b*, 20*c* can negatively impact the readability of the barcode 12 by impacting the size of the pixels through what is known as print growth. Print growth refers to the size of adjacent pixels in the barcode 12. FIG. 3 illustrates three pixels 30, 32, 34 from the barcode 12 of FIG. 1. As noted above, one of the factors that affects the readability of the 2D barcode 12 is the size consistency of each of the pixels 30, 32, 34. Readability will be best if the width a of pixel 30, the width b of pixel 32, and the width c of pixel 34 are equal. Thus, if a=b=c, the print growth with respect to pixels 30, 32, 34 will be zero. However, if the print growth between adjacent pixels is not zero, the readability will decrease. As shown in FIG. 4, the readability of the barcode 12 is greatest when the print growth is zero, and the readability decreases as the print growth increases. If pixel 32 is a black pixel, a plurality of dots will be printed in the pixel 32. If the medium on which the pixels 30-34 are located is moving to the right, such that pixel 34 will be printed first, pixel 32 printed next and then pixel 30 printed last, the dots being printed near the left edge of pixel 32 will have satellites that contact the medium in pixel 30. The satellites will effectively increase the width b of the pixel 32 and decrease the width a of the pixel 30. Thus, b will be greater than a, which results in a print growth of greater than zero, which reduces the readability of the barcode 12. As the speed of movement of the medium onto which the image is being printed increases, the satellites from the dots in pixel 32 will extend further into the pixel 30, further increasing the print growth and thus decreasing the readability. There is, therefore, a limitation imposed upon the speed of the medium when using drop-on-demand ink-jet technology to ensure that readability of the image will not be affected. In a mail processing system, this limitation determines the maximum speed at which the mail pieces can be transported and printed upon, and therefore limits the maximum throughput of the mail processing system. It would be desirable to be able to utilize drop-on-demand ink-jet technology for printing applications that does not impose these limitations with respect to the speed of the medium being printed upon, thereby enabling high speed printing.

Thus, there exists a need for a method and system that enables ink-jet printing technology to be used for high speed printing by compensating for droplet satellites to maintain readability of the images formed during printing.

SUMMARY OF THE INVENTION

The present invention alleviates the problems associated with the prior art and provides methods and systems that enable ink-jet printing technology to be used for high speed printing by compensating for and utilizing droplet satellites to maintain readability of the images formed during printing.

In accordance with embodiments of the present invention, print growth between pixels in an image is significantly reduced or eliminated when using drop-on-demand ink-jet technology to print on media that is moving at high speed, thereby ensuring that the readability of the image remains high, by adjusting the printing of the pixels in the image based on the status of the following pixel to be printed, i.e., whether the following pixel is either black or white. If a black pixel, formed by a plurality of columns of dots, is being followed by a white pixel, the column of dots closest to the white pixel will not be printed, thereby removing any satellites from this column of dots that may fall into the white pixel, and the column of dots in the black pixel next to the column of dots closest to the white pixel are staggered such that the pixel appears filled to a reader despite the absence of the column of dots closest to the white pixel.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 5:
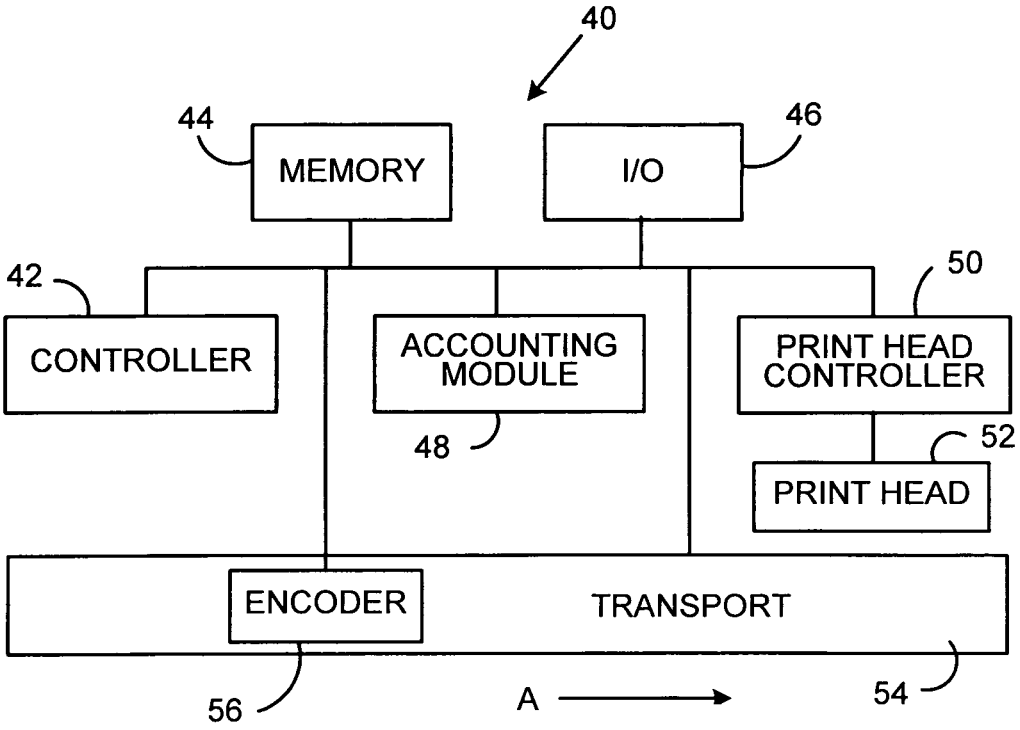
FIG. 5 illustrates in block diagram form a portion of a mail processing system in which the present invention can be utilized.

In describing the present invention, reference is made to the drawings, wherein there is seen in FIG. 5 a block diagram of a portion of a mail processing system 40, such as a mailing machine, in which embodiments of the present invention can be utilized. It should be noted that while the following description is being made with respect to a mail processing system, the present invention is not so limited and can be utilized in any type of system that requires high speed printing using ink-jet technology. Mail processing system 40 includes a controller 42, that preferably includes one or more controller units, such as, for example, a microprocessor, general or special purpose processor or the like, to control operation of the mail processing system 40. A memory 44 is coupled to the controller 42 for storage of software executable by controller 42, e.g., processing instructions utilized by controller 42, and data generated during operation of mail processing system 40. Controller 42 is coupled to one or more input/output devices 46, such as, for example, a keyboard and/or display unit for the input and output of various data and information. An accounting module 48 (e.g., a postage meter) for tracking postal funds is coupled to the controller 42. A print head controller 50 is also coupled to the controller 42. Print head controller 50 may be separate or integral with the controller 42. A print head 52, preferably an ink-jet printer adapted to print postage indicia generated by the controller 42 on mail pieces, is coupled to and generally controlled by the print head controller 50. Print head controller 50 may also utilize software, e.g., processing instructions, stored in memory 44, or alternatively may also include an internal memory (not shown) that stores processing instructions. Ink-jet print head 52 may be any type of ink-jet print head (e.g., thermal (bubble) ink-jet or piezoelectric ink-jet). A transport 54, including, for example, rollers and/or belts, is utilized to transport mail pieces through the mail processing system 40 in the direction indicated by arrow A based on signals provided from the controller 42. The transport 54 will transport the mail pieces past the print head 52 such that printing can occur on each mail piece. Additionally, the controller 42 is in operative communication with an encoder 56. Encoder 56 is included as part of the transport 54, and sends signals to the controller 42, indicating movement of the transport 54, and thus mail pieces, based on changes of state of the encoder 56. The signals from encoder 56 are used to control firing pulses for ink-jet print head 52. In response to the firing pulses, selected nozzles are activated, thereby ejecting ink. Those skilled in the art will recognize that the various components of the system 40 are in operative communication with each other over conventional communication lines, such as a communication bus.

Figure 6:
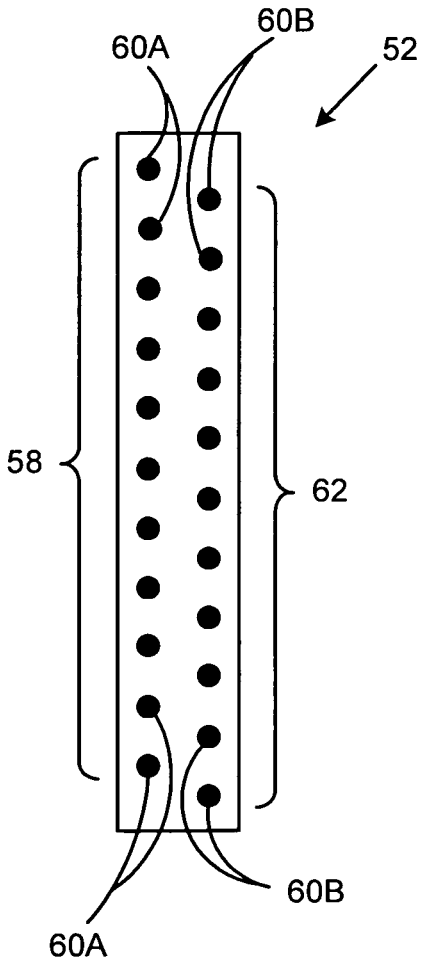
FIG. 6 illustrates the nozzle assembly of an ink-jet print head.

A schematic diagram of the nozzle assembly of ink-jet print head 52 is shown in FIG. 6. Ink-jet print head 52 includes a first array 58 (commonly called the odd array) of vertically oriented nozzles 60A and a second array 62 (commonly called the even array) of vertically oriented nozzles 60B. The arrays 58, 62 are spaced a predetermined distance apart, such as, for example, approximately 0.0133 inches. Each nozzle 60A, 60B has a corresponding ejection element (not shown) for causing the ejection of a drop of ink. As seen in FIG. 6, nozzles 60A and 60B are offset from one another along the horizontal axis of ink-jet print head 52 and alternate along the vertical axis of ink-jet print head 52. As will be appreciated, the relative vertical spacing of the nozzles 60A and 60B determines the vertical printer resolution of ink-jet print head 52.

Figure 7:
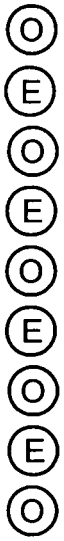
FIG. 7 is a schematic diagram showing a straight line printed with a portion of the ink-jet print head of FIG. 6.

The firing of first array 58 and second array 62 is controlled by signals generated by controller 42 and/or print head controller 50 based on signals received from encoder 56. Thus, for example, if the arrays 58, 62 are spaced 0.0133 inches apart and it is desired to print a straight vertical line, the first array 58 will be fired, thereby depositing drops of ink on the medium from the nozzles 60A, and after the medium has moved 0.0133 inches the second array 62 will be fired, thereby depositing drops of ink on the medium from the nozzles 60B. Thus, the ink drops fired from the nozzles 60A, 60B of the odd array 58 and the even array 62 will align to produce a vertical line as illustrated in FIG. 7, where each circle indicates a single ink droplet from a nozzle 60A, 60B, with the character "E" in a circle indicating that the corresponding droplet was printed by a nozzle in the even array 58 and the character "O" in a circle indicating that the corresponding droplet was printed by a nozzle in the odd array 62.

Figure 1:
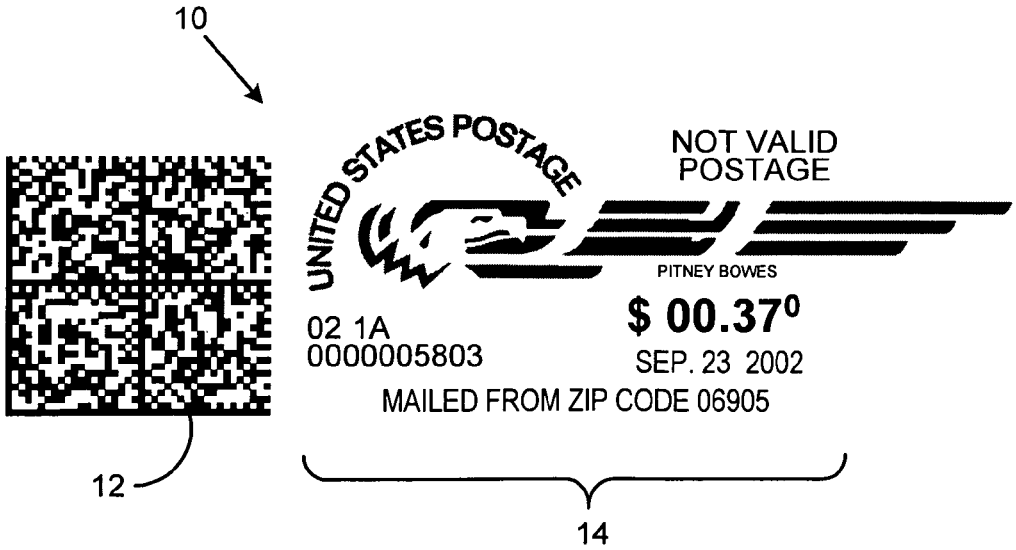
FIG. 1 ( PRIOR ART )
FIG. 1 illustrates an example of an indicium that meets the IBIP specifications.
Figure 3:
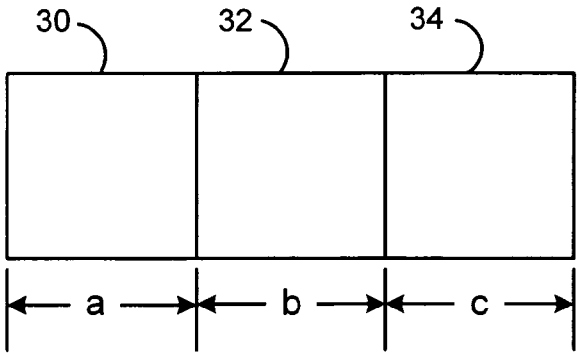
FIG. 3 illustrates three adjacent pixels from the barcode of the indicium illustrated in FIG. 1.
Figure 4:
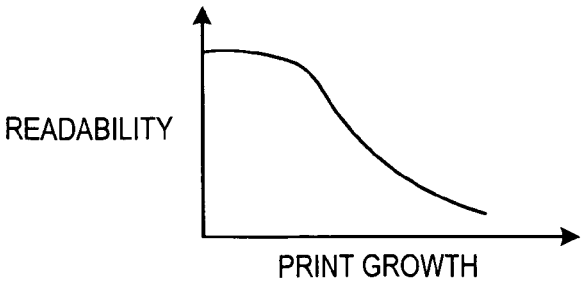
FIG. 4 illustrates a graph showing the readability of a barcode versus the print growth of the pixels in the barcode.
Figure 2A:
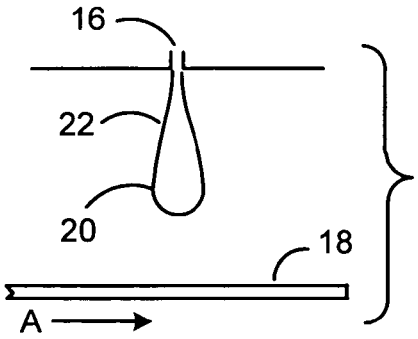
FIGS. 2A-2D illustrate the discharge of an ink droplet from an ink-jet print head.
Figure 2B:
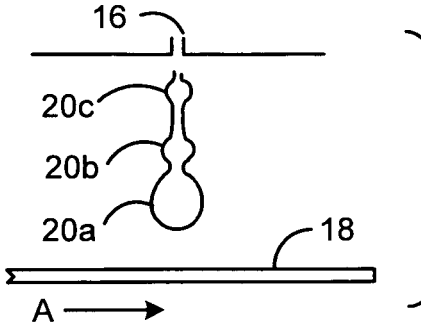
Figure 2C:
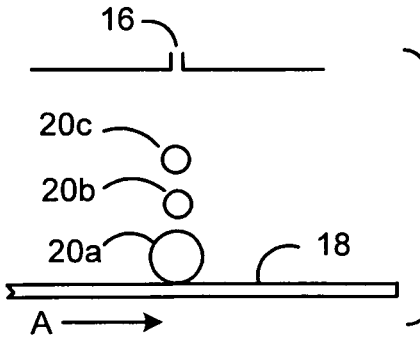
Figure 2D:
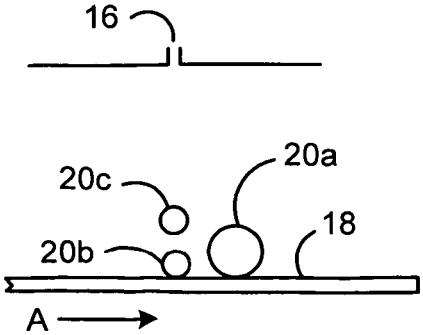
Figure 8:
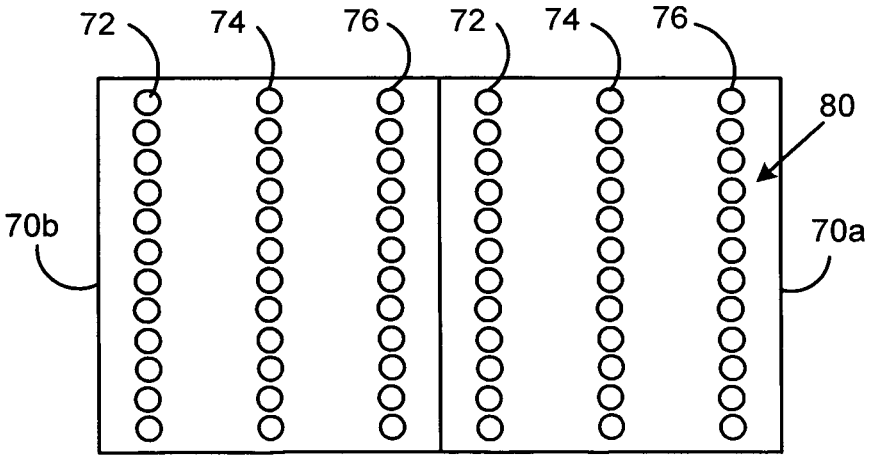
FIG. 8 illustrates a pair of adjacent pixels in a barcode, and the density for the placement of ink drops required for the pixels to be black when printing at a specified resolution.

As previously noted, the 2D barcode 12 of the indicium 10 illustrated in FIG. 1 is approximately 0.8 inches by 0.8 inches and formed by a 40×40 array of 0.020 by 0.020 inch pixels, with each pixel being either black or white. If the pixel is black, a plurality of ink drops are printed in the pixel with sufficient density such that the pixel will appear to a reader to be filled with ink. FIG. 8 illustrates a pair of adjacent pixels 70*a*, 70*b* in a barcode, such as barcode 12 of FIG. 1, with each pixel 70*a*, 70*b* being formed by a plurality of circles 80 arranged in a plurality of columns and rows. The number of circles 80, and hence number of columns and rows illustrated in FIG. 8, shows the placement of ink drops for the pixels 70*a*, 70*b* when the printing resolution is 150 dots per inch (dpi) in the horizontal direction by 600 dpi in the vertical direction. As shown, therefore, each pixel includes three columns 72, 74 and 76, evenly spaced across the width of the pixels 70*a*, 70*b*, with each column having twelve evenly spaced rows. It should be understood, of course, that at different resolutions each pixel 70*a*, 70*b* will contain a different number of columns and rows of circles 80. To make the pixels 70*a*, 70*b* black, in conventional inkjet printing systems each circle 80 in the columns 72, 74, 76 will be filled with a droplet of ink ejected from the nozzles 60A and 60B as described above to produce a vertical line. As noted above, however, if the medium on which the barcode 12 is being printed, e.g., a mail piece, is moving from left to right such that the column 76 will be printed first, then column 74 will be printed, and then column 72 will be printed, the satellites that develop from the ink droplets printed in column 72 of pixel 70*a* will contact the medium outside of the pixel 70*a* and in adjacent pixel 70*b*. If the pixel 70*b* is also a black pixel, then the satellites from ink droplets printed in column 72 in pixel 70*a* that land in pixel 70*b* will not have any negative impact on the size of each of the pixels 70*a*, 70*b*, since the circles 80 in column 76 of pixel 70*b* will also be filled with ink drops, thereby covering the satellites from the ink droplets printed in column 72 of pixel 70*a*. If however, the pixel 70*b* is a white pixel, then the satellites from ink droplets printed in column 72 of pixel 70*a* will effectively reduce the size of pixel 70*b* and increase the size of pixel 70*a*, thereby resulting in print growth, as previously described, that will reduce the readability of the barcode 12.

Figure 9:
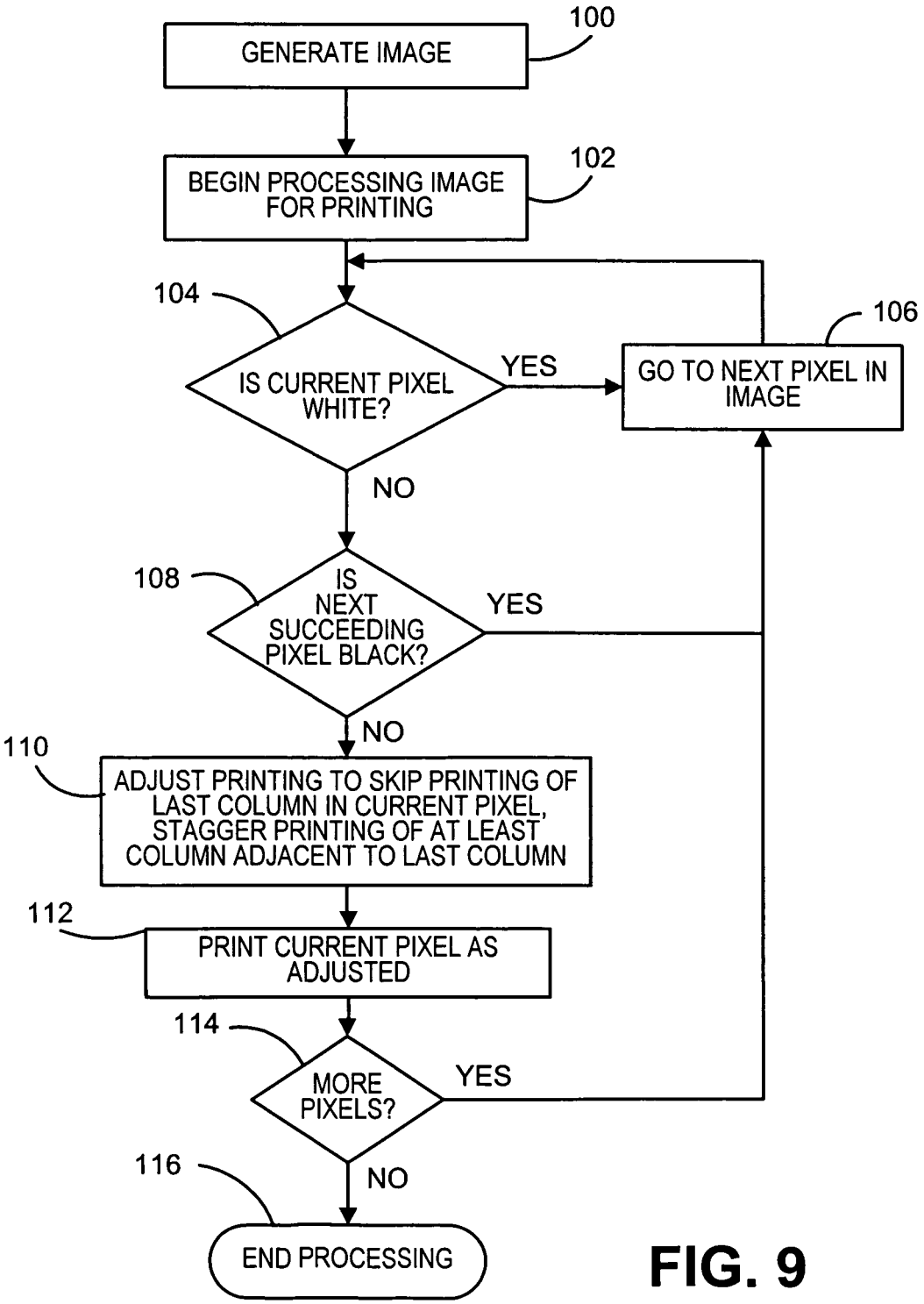
FIG. 9 illustrates in flow chart form the processing performed by the mail processing system of FIG. 5 according to an embodiment of the present invention.

According to embodiments of the present invention, print growth is significantly reduced or eliminated, thereby ensuring that the readability of the barcode 12 remains high, in applications in which high-speed printing is desirable. As described below, this is accomplished by adjusting the printing of the pixels in the image based on the status of the following pixel to be printed, i.e., whether the following pixel is either black or white, and advantageously utilizing the satellites to complete a pixel. Referring now to FIG. 9, the processing performed by the mail processing system 40 according to an embodiment of the present invention is illustrated in flow chart form. In step 100, an indicium image, such as illustrated in FIG. 1, is generated for a mail piece by the controller 42. The image includes the 2D barcode 12. In step 102, processing of the generated image, and more specifically the 2D barcode 12, according to an embodiment of the invention begins. Such processing could be performed, for example, by the print head controller 50, by the controller 42, or a combination of the two utilizing software instructions, such as, for example, software stored in the memory 44. Processing of the 2D barcode 12 occurs on a pixel by pixel basis, until all of the pixels in the 2D barcode 12 have been processed. In step 104, it is determined if the current pixel being processed is a white pixel, i.e., no printing will occur in the pixel. If the current pixel is a white pixel, there is no printing in the current pixel, and therefore no risk of any satellites causing print growth of the current pixel. Thus, if the current pixel is a white pixel, no processing is necessary, and in step 106 the next pixel is selected for processing and the method returns to perform step 104 on the next pixel.

Figure 10:
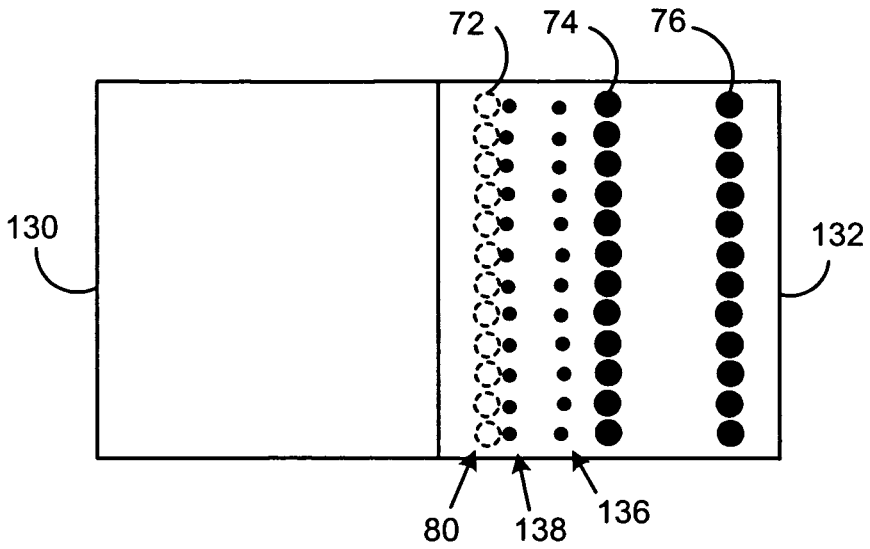
FIG. 10 illustrates a pair of adjacent pixels in a barcode printed according to a portion of the processing of the present invention.

If in step 104 it is determined that the current pixel is not white, i.e., the current pixel is black and therefore printing will occur in the pixel, then in step 108 it is determined if the next succeeding pixel, i.e., the pixel that is adjacent to the current pixel, is black. If the next succeeding pixel will also be black, there is no risk of any satellites causing print growth of the current pixel, since printing will also occur in the next succeeding pixel. Thus, if the next succeeding pixel is a black pixel, there is no processing necessary for the current pixel, and in step 106 the next pixel is selected for processing and the method returns to perform step 104 on the next pixel. If the next succeeding pixel will not be a black pixel, i.e., it will be a white pixel, this means that a white pixel will follow a black pixel, and print growth can possibly occur due to the satellites that form from the printing that occurs in the black pixel contacting the medium in the white pixel. To prevent this, in step 110, the printing of the current pixel (which is to be black) is adjusted such that the entire column of dots immediately adjacent to the edge of the pixel nearest the next succeeding pixel will not be printed. FIG. 10 illustrates a pair of adjacent pixels 130, 132 in which the entire column of dots immediately adjacent to the edge of the pixel nearest the next succeeding pixel is not printed. As illustrated, pixel 132 is a black pixel, and pixel 130 is a white pixel. The medium on which the image will be printed, e.g., a mail piece, will be moving such that pixel 132 will be printed before pixel 130. As illustrated in FIG. 10, the circles 80 in columns 74 and 76 of pixel 132 are filled with ink droplets while the circles 80 of column 72 (shown as dashed lines) are not filled with droplets of ink. Since the column 72 is not printed, there are no satellites formed that will fall into pixel 130 that would increase the width of pixel 132 while decreasing the width of pixel 130. The satellites formed from the ink droplets for column 74, shown generally by reference numbers 136 and 138 in FIG. 10, will still contact the medium within the pixel 132. It should be noted, of course, that the exact positioning of the satellites 136, 138 may not be as shown and may vary dependent upon, among other things, the speed of movement of the medium and type of ink. Thus, the faster the medium is moving, the further apart the satellites 136, 138 will be, thereby making the pixel 132 appear completely filled.

Although removing the printing of the last column 72 of dots in pixel 132 prevents the pixel 132 from increasing in width with respect to pixel 130, it can introduce another problem known as negative print growth. For example, if the medium is not moving fast enough, or the satellites do not separate sufficiently from the main droplet, the satellites 136, 138 can contact the medium too close to the main droplet in column 74 of pixel 132, thereby effectively decreasing the width of the pixel 132 and increasing the width of the pixel 130. This negative print growth will also lead to low readability.

Figure 11:
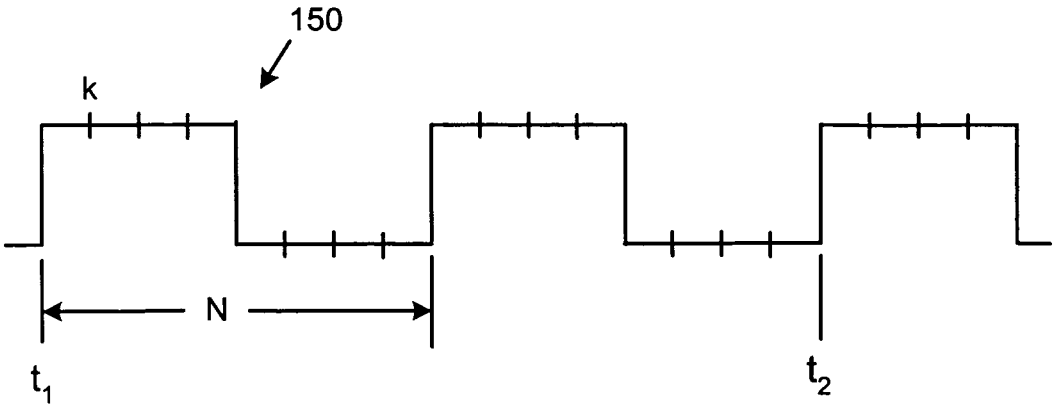
FIG. 11 illustrates a timing diagram utilized for firing of the nozzles of an ink-jet print head according to the present invention.

According to the present invention, the possibility of negative print growth is reduced by further adjusting printing of each pixel (step 110 of FIG. 9) before printing such that the printing of dots in at least the next to last column is staggered to help complete a pixel that is black. FIG. 11 illustrates a timing diagram utilized for firing of the nozzles of an ink-jet print head, such as the nozzles 60A, 60B of print head 52 (FIG. 6), according to embodiments of the present invention. In particular, a clock line 150 is generated to control the firing of the nozzles 60A, 60B of the print head 52. Clock line 52 consists of a series of N cycles, where each cycle N represents movement of the medium by approximately one-half the distance between the arrays 58, 62. Thus, if the spacing between the arrays 58, 62 is 0.013 inches, each cycle N occurs when the medium moves 0.0067 inches. To print a straight vertical line (as illustrated in FIG. 7), at time t1 the first array 58 will be fired, thereby depositing drops of ink on the medium from the nozzles 60A, and at time t2, 2N cycles later when the medium has moved 0.0133 inches, the second array 62 will be fired, thereby depositing drops of ink on the medium from the nozzles 60B. Thus, the ink drops fired from the nozzles 60A, 60B of the odd array 58 and the even array 62 will align to produce a vertical line. Each cycle N can be separated into k equal increments, and through software control provided in print head controller 50, instead of firing the arrays 58 and 62 at times t1 and t2, respectively, the firing of one or both of the arrays 58, 62 can be delayed by any increment of k in the cycle N. Thus, for example, if array 58 is fired at time t1, the firing of array 62 can be delayed until time t2+mk, where m is some integer, thereby staggering the dots printed instead of producing a straight vertical line.

Thus, referring again to FIG. 9, in step 110 the printing is also adjusted to stagger the printing of the ink droplets of the next to last column in the current pixel. Optionally, the printing of each pixel could be adjusted in step 110 to stagger every column that will be printed, e.g., columns 74 and 76, instead of just the next to last column, e.g., column 74. In step 112, the current pixel is printed, as adjusted in step 110, such that the entire column of dots adjacent to the edge of the pixel nearest the next succeeding pixel is not printed, and the dots printed in at least the column next to the column of dots adjacent to the edge of the pixel nearest the next succeeding pixel are staggered staggered. In step 114, it is determined if there are more pixels to be processed, and if so, then in step 106 the next pixel is selected for processing and the method returns to perform step 104 on the next pixel. If there are no more pixels in the 2D barcode to be processed, then the processing stops in step 116.

Figure 12:
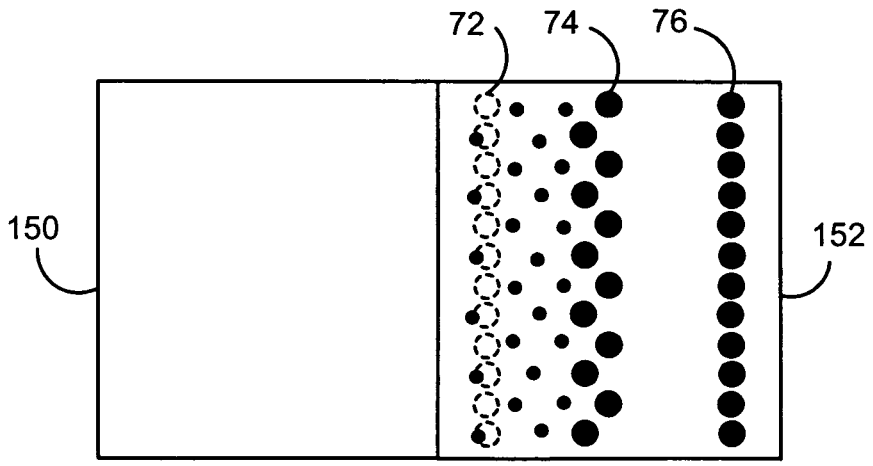
FIG. 12 illustrates a pair of adjacent pixels in a barcode printed according to the complete processing of the present invention.

FIG. 12 illustrates a pair of adjacent pixels 150, 152 processed according to the present invention as illustrated in FIG. 9. The pixels 150, 152 are part of an indicium image, and more specifically a 2D barcode, generated in step 100. As illustrated, pixel 152 is a black pixel, and pixel 150 is a white pixel. The medium on which the image will be printed, e.g., a mail piece, will be moving such that pixel 152 will be printed before pixel 150. Thus, the processing of pixel 152 will occur before the processing of pixel 150. In step 104, the current pixel, i.e., pixel 152 is black, so processing proceeds to step 108 where it is determined that the next succeeding pixel, i.e., pixel 150, is not black. In step 110, the printing for pixel 152 is adjusted such that the full column of dots immediately adjacent to the edge of the pixel 152 nearest the next succeeding pixel 150, which is column 72 as illustrated in FIG. 12, will not be printed, and the dots printed in the next to last column, i.e., column 74, will be staggered by delaying the firing of the array 62 of print head 52 (FIG. 6). In step 112, the pixel 152 as adjusted is printed, and as illustrated in FIG. 12, the column 76 is printed as a straight line, the column 74 is printed as a staggered line, and the circles 80 of column 72 (shown as dashed lines) are not filled with droplets of ink. It should be understood, of course, that column 76 cold also be staggered if desired. Since the column 72 is not printed, there are no satellites formed that will fall into pixel 150 that would increase the width of pixel 152 while decreasing the width of pixel 150. In addition, since the column 74 is staggered, the satellites formed for the ink droplets ejected from the even array 62, the firing of which was delayed by some interval after time t2 as illustrated in FIG. 11, will contact the medium closer to the edge of the boundary between the pixels 152, 150, thereby further filling the pixel 152 and ensuring that its width remains constant relative to pixels that are white. Thus, the possibility of print growth, either positive or negative, is significantly reduced, if not completely eliminated, utilizing the present invention and drop-on-demand ink-jet technology can be utilized for high speed printing without affecting the readability of the image printed.

Thus, standard drop-on-demand ink-jet technology, which heretofore had limitations with respect to the speed at which the medium being printed upon could travel, can now be utilized for high speed printing using the present invention. Print growth between pixels in an image is significantly reduced or eliminated by the present invention, thereby ensuring that the readability of the image remains high, by adjusting the printing of the pixels in the image based on the status of the following pixel to be printed, i.e., whether the following pixel is either black or white. If a black pixel, formed by a plurality of columns of dots, is being followed by a white pixel, the column of dots closest to the white pixel will not be printed, thereby removing any satellites from this column of dots that may fall into the white pixel, and the column of dots in the black pixel next to the column of dots closest to the white pixel can be staggered such that the pixel appears filled despite the absence of the column of dots closest to the white pixel.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description.

What is claimed is:

1. A method for printing an image on a medium using an ink-jet print head, the image including a plurality of pixels each of which may be printed by the ink-jet print head depositing a plurality of ink drops arranged in a plurality of spaced columns, the method comprising:

determining if a current pixel of the image is to be printed;

if a current pixel is to be printed, determining if a following pixel adjacent to the current pixel is to be printed;

if the following pixel adjacent to the current pixel is not to be printed, adjusting printing of the current pixel such that ink drops from the ink-jet print head will be ejected to form all columns in the current pixel except for a column nearest to the following pixel adjacent to the current pixel and staggering at least a portion of the plurality of ink drops that form a column adjacent to the column nearest to the following pixel adjacent to the current pixel; and printing the current pixel as adjusted.

2. The method of claim 1, wherein ink drops ejected from the ink-jet print head break into a main drop and at least one satellite, the method further comprising:

using satellites formed from ink drops ejected from the ink-jet print to maintain a constant width of the current pixel with respect to other pixels in the image that are not printed.

3. The method of claim 1, wherein the number of columns in each pixel is three.

4. The method of claim 1, wherein the medium is a mail piece and the image is a portion of a postage indicium for the mail piece.

5. The method of claim 4, wherein the portion of the postage indicium is a 2D barcode.

6. An apparatus for printing an image on a medium, the image including a plurality of pixels each of which may be printed by depositing a plurality of ink drops arranged in a plurality of evenly spaced columns, the apparatus comprising:

a print head having a plurality or arrays of nozzles for ejecting ink drops onto a medium to form the image;

a controller for controlling the ejection of ink drops by the plurality of arrays of nozzles; and a memory coupled to the controller and storing software executable by the controller, the software including instructions for:

determining if a current pixel of the image is to be printed;

if a current pixel is to be printed, determining if a following pixel adjacent to the current pixel is to be printed; and if the following pixel adjacent to the current pixel is not to be printed, adjusting printing of the current pixel such that ink drops from the print head will be ejected to form all columns in the current pixel except for a column nearest to the following pixel adjacent to the current pixel and staggering at least a portion of the plurality of ink drops that form a column adjacent to the column nearest to the following pixel adjacent to the current pixel, wherein the controller will cause the print head to print the current pixel as adjusted.

7. The apparatus of claim 6, wherein ink drops ejected from the print head break into a main drop and at least one satellite, and the satellites formed from ink drops ejected from the print head are used to maintain a constant width of the current pixel with respect to other pixels in the image that are not printed.

8. The apparatus of claim 6, wherein the number of columns in each pixel is three.

9. The apparatus of claim 6, wherein the medium is a mail piece and the image is a portion of a postage indicium for the mail piece.

10. The apparatus of claim 9, wherein the portion of the postage indicium is a 2D barcode.

11. A mail processing system for preparing a mail piece comprising:

a first controller to generate an indicium image to be printed on a mail piece, the indicium image including a 2D barcode formed by a plurality of pixels each of which may be printed by depositing a plurality of ink drops arranged in a plurality of evenly spaced columns;

a print head having a plurality or arrays of nozzles for ejecting ink drops onto the mail piece;

a transport device to transport the mail piece past the print head;

a second controller coupled to the first controller and the print head for controlling the ejection of ink drops by the plurality of arrays of nozzles of the print head; and a memory coupled to the first and second controllers and storing software executable by the first and second controllers, the software including instructions for:

determining if a current pixel of the 2D barcode is to be printed;

if a current pixel is to be printed, determining if a following pixel adjacent to the current pixel is to be printed; and if the following pixel adjacent to the current pixel is not to be printed, adjusting printing of the current pixel such that ink drops from the print head will be ejected to form all columns in the current pixel except for a column nearest to the following pixel adjacent to the current pixel and staggering at least a portion of the plurality of ink drops that form a column adjacent to the column nearest to the following pixel adjacent to the current pixel, wherein the print head will print the current pixel as adjusted.

12. The mail processing system of claim 11, wherein ink drops ejected from the print head break into a main drop and at least one satellite, and the satellites formed from ink drops ejected from the print head are used to maintain a constant width of the current pixel with respect to other pixels in the 2D barcode that are not printed.

13. The mail processing system of claim 11, wherein the number of columns in each pixel is three.

* * * * *